US006809718B2

(12) United States Patent
Wei et al.

(10) Patent No.: US 6,809,718 B2
(45) Date of Patent: Oct. 26, 2004

(54) TFT-LCD CAPABLE OF ADJUSTING ITS LIGHT SOURCE

(75) Inventors: Chung-Kuang Wei, Kao-Hsiung Hsien (TW); Chao-Wen Wu, I-Lan Hsien (TW)

(73) Assignee: Chi Mei Optoelectronics Corporation, Tainan (TW)

( * ) Notice: Subject to any disclaimer, the term of this patent is extended or adjusted under 35 U.S.C. 154(b) by 321 days.

(21) Appl. No.: 10/064,107

(22) Filed: Jun. 12, 2002

(65) Prior Publication Data

US 2003/0137485 A1 Jul. 24, 2003

(30) Foreign Application Priority Data

Jan. 18, 2002 (TW) ..... 91100809 A

(51) Int. Cl.[7] ..... G09G 3/36
(52) U.S. Cl. ..... 345/102; 345/207; 348/602
(58) Field of Search ..... 345/102, 87, 204, 345/207, 92, 589; 348/602

(56) References Cited

U.S. PATENT DOCUMENTS 4,760,389 A * 7/1988 Aoki et al. ..... 345/102
5,270,818 A * 12/1993 Ottenstein ..... 348/602
5,717,422 A * 2/1998 Fergason ..... 345/102
5,952,992 A * 9/1999 Helms ..... 345/102
6,078,302 A * 6/2000 Suzuki ..... 345/77
6,094,185 A * 7/2000 Shirriff ..... 345/102
6,664,744 B2 * 12/2003 Dietz ..... 315/291

* cited by examiner

*Primary Examiner*—Kent Chang
(74) *Attorney, Agent, or Firm*—Winston Hsu

(57) ABSTRACT

A thin film transistor liquid crystal display (TFT-LCD) capable of adjusting its light source utilizes at least one thin film transistor (TFT) disposed in a peripheral region of a bottom substrate as a photo sensor for detecting ambient illumination. Then, a light source modulator can enhance, weaken, open or close the light source of the TFT-LCD to an optimal brightness level that depends on the ambient illumination spontaneously.

11 Claims, 6 Drawing Sheets

TFT-LCD CAPABLE OF ADJUSTING ITS LIGHT SOURCE

BACKGROUND OF INVENTION

1. Field of the Invention

The present invention relates to a thin film transistor liquid crystal display (TFT-LCD) capable of adjusting its light source, and more particularly, to a TFT-LCD having a photo sensor.

2. Description of the Prior Art

Display devices that have a back light source such as a liquid crystal display (LCD) are usually used in portable electronic devices such as a notebook, an electronic dictionary, and a personal digital assistant (PDA) etc. When users utilize the display device that has the back light source, ambient illumination affects the ability of the users to view the display device directly. Therefore, the above-mentioned portable electronic devices need a suitable light source adjusting mechanism to adjust the back light source.

The prior art light source adjusting mechanism is mainly a manual light source adjusting mechanism. The users can adjust the back light source of the display devices by way of a specific light source adjusting knob or keys of a keyboard disposed on the device. However, the prior art mechanism has two disadvantages. First, when the LCD is used in portable electronic products, the portable electronic products are usually in various background environments, such as in a moving car. Therefore the users must adjust the back light source often, causing inconvenience for the user. Second, the users could adjust the back light source to a brighter brightness level to prevent the operational inconvenience, but this leads to high power consumption.

Please refer to FIG. 1. FIG. 1 is a circuit diagram of a prior art back light adjusting circuit 10. The back light adjusting circuit 10 includes a back light source 12 for generating backlight, a photo sensor 14, an amplified circuit 16, a decisive circuit 18, and a DC/AC inverter 20. The back light source 12 and the inverter 20 are composed of a back light module, and the back light module generates the backlight with various brightness levels depending on ambient illumination 22.

When the photo sensor 14, such as a photosensitive resistance or a charge coupled device (CCD) senses the ambient illumination 22, the photo sensor 14 generates a corresponding photocurrent $i_p$ that depends on the ambient illumination 22. Since photocurrent $i_p$ generated from the photo sensor 14 is very weak, the amplified circuit 16 is used to amplify the photocurrent $i_p$ to conveniently perform the subsequent signal processes. The amplified circuit 16 includes a transistor Q1, a resistance R1 and a resistance R2, functioning as an amplifier, and a voltage source $V_{DC}$ for providing a bias voltage. When a base of the transistor Q1 receives a voltage signal converted from the photocurrent $i_p$ by the resistance R1, an amplified signal 24 is sent from a collector of the transistor Q1 to the decisive circuit 18 to calculate the ambient illumination 22.

The decisive circuit 18 includes a photo diode D1. An anode of the photo diode D1 receives the amplified signal 24, and then a back light control signal 26 is calculated and sent from a cathode of the photo diode D1 to the inverter 20. The inverter 20 receives the back light control signal 26 and transforms it into a current, which is used to drive the back light source 12. The inverter 20 includes a transistor Q2 for receiving a driving voltage and producing a switching voltage, a transformer T1 for transforming the switching voltage to a loading voltage for providing to the back light source 12, a pulse width modulation (PWM) controller 28 that generates a pulse width modulate signal 29 corresponding to a pulse width according to the received back light control signal 26 and transfers the pulse width modulate signal 29 to the base of the transistor Q2. By turning on and off the transistor Q2, a voltage source $V_M$ is indirectly connected to the transformer T1. And a corresponding driving current is produced so that the back light source 12 generates a corresponding back light.

When the prior art back light adjusting circuit 10 is applied to a display device (not shown), an output circuit of the inverter 20 can be modulated according to the back light control signal 26 sent from the decisive circuit 18 to adjust the back light source 12 spontaneously when the back light source 12 of the display device is turned on. However, the prior art back light adjusting circuit 10 has several disadvantages. First, the prior art back light adjusting circuit utilizes the additional photo sensor, increasing costs and volume of the display device. Second, the back light adjusting circuit is applied to the display device which has the back light source. However, for display devices which have a front light source, the ambient illumination and the front light source are on same side. Therefore, if variations of the ambient illumination are acute enough, the ability of users to view the display device will be severely affected.

SUMMARY OF INVENTION

It is therefore a primary objective of the claimed invention to provide a thin film transistor liquid crystal display (TFT-LCD) capable of adjusting its light source that depends an ambient illumination spontaneously, without consuming power and causing eyestrain.

It is another objective of the claimed invention to provide a light source adjusting mechanism that applies to a back light source and a front light source.

According to the claimed invention, a thin film transistor liquid crystal display (TFT-LCD) capable of adjusting its light source includes a liquid crystal sealed between a first substrate and a second substrate, with the second substrate having an active region and a peripheral region. The TFT-LCD also includes a pixel matrix array disposed in the active region of the second substrate, and at least one thin film transistor (TFT) functioning as a photo sensor disposed in the peripheral region of the second substrate, with the TFT having an amorphous silicon layer. The TFT-LCD further includes a feedback circuit, and a light source module that includes the light source and a light source modulator. When ambient light enters the first substrate and passes through the amorphous silicon layer of the TFT, the TFT generates a current in the feedback circuit. Then a feedback signal is sent from the feedback circuit to the light source modulator to adjust the light source of the TFT-LCD to an optimal brightness level that depends on ambient illumination.

It is an advantage that the claimed invention uses the TFT disposed in the peripheral region of the second substrate as the photo sensor to detect the ambient illumination and that the light source modulator can enhance, weaken, open, or close the light source of the TFT. Therefore, manufacturing costs are reduced, without consuming power and causing eyestrains.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
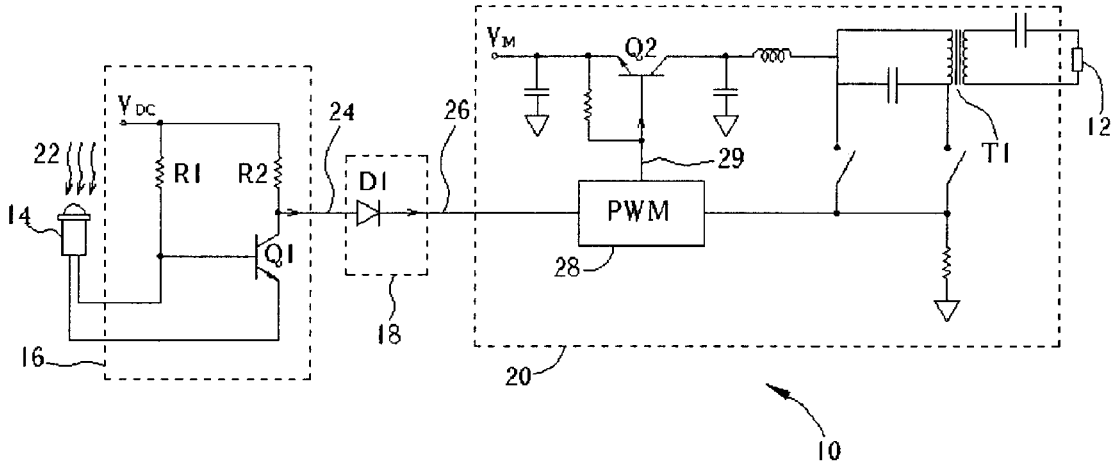
Fig. 1 Prior art
FIG. 1 is a circuit diagram of a prior art back light adjusting circuit.
Figure 2:
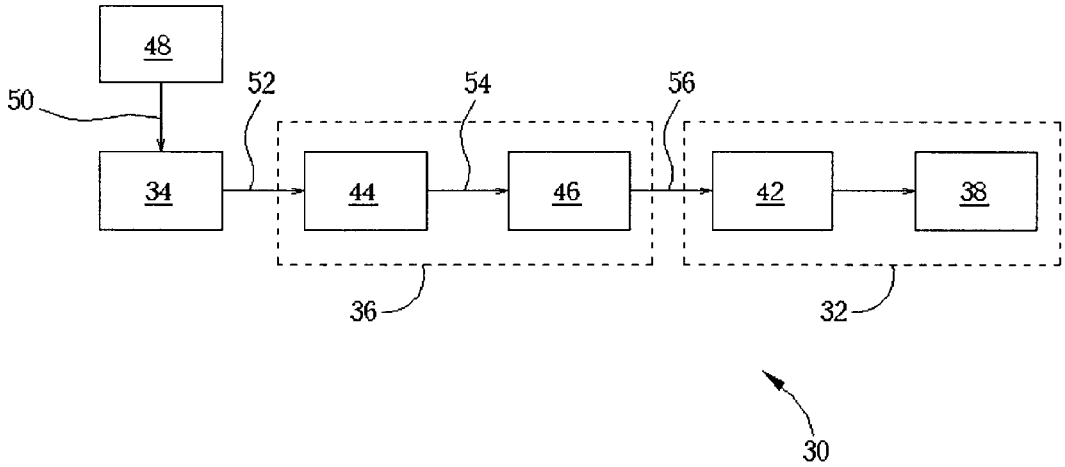
FIG. 2 is a block diagram of a light source adjusting circuit according to the present invention.
Figure 3:
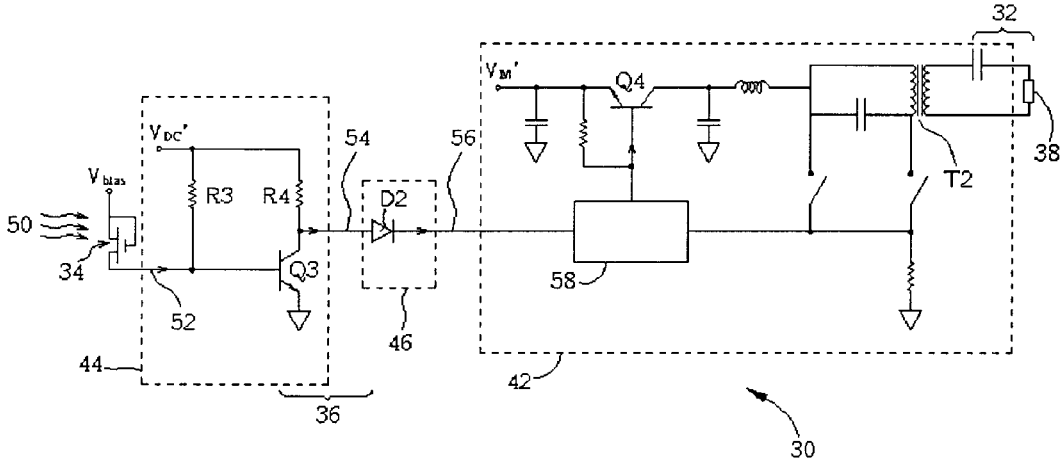
FIG. 3 is a circuit diagram of the light source adjusting circuit according to the present invention.
Figure 4:
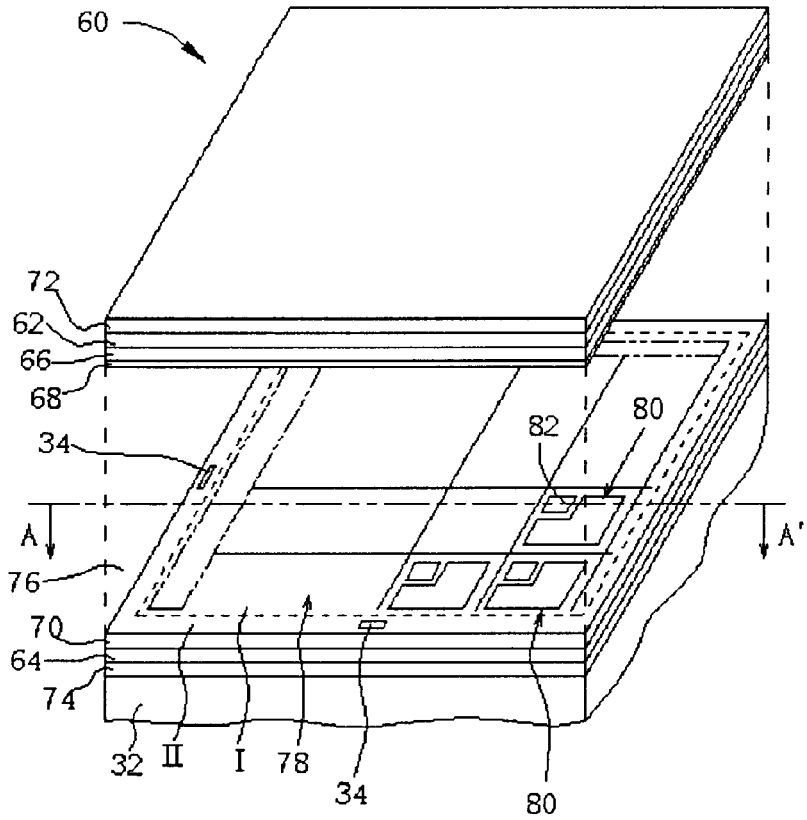
FIG. 4 is a schematic diagram of a thin film transistor liquid crystal display (TFT-LCD) capable of adjusting its light source according to the present invention.
Figure 5:
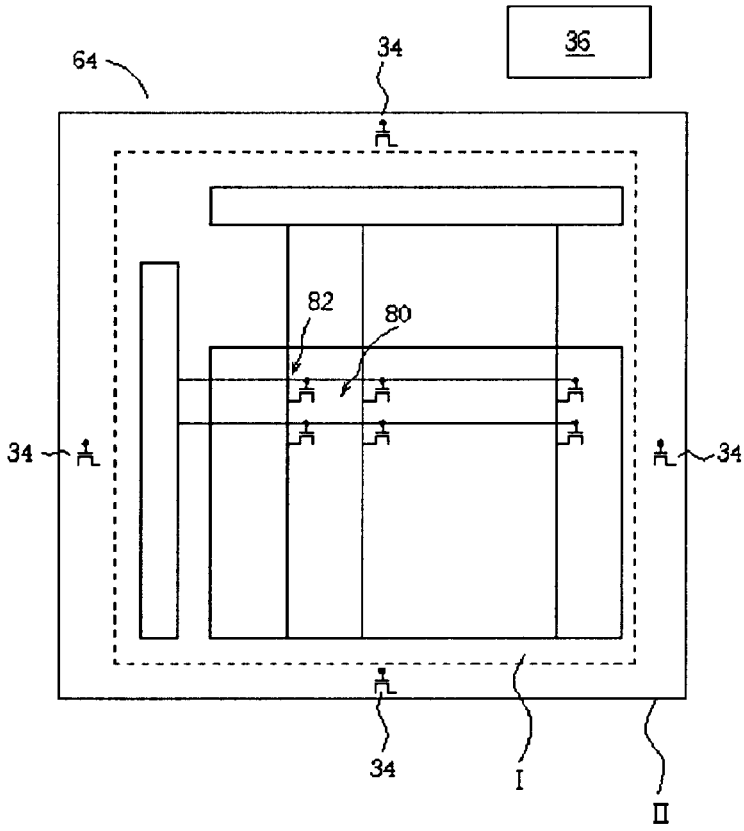
FIG. 5 is a top view illustrating a second substrate of the TFT-LCD according to the present invention.
Figure 6:
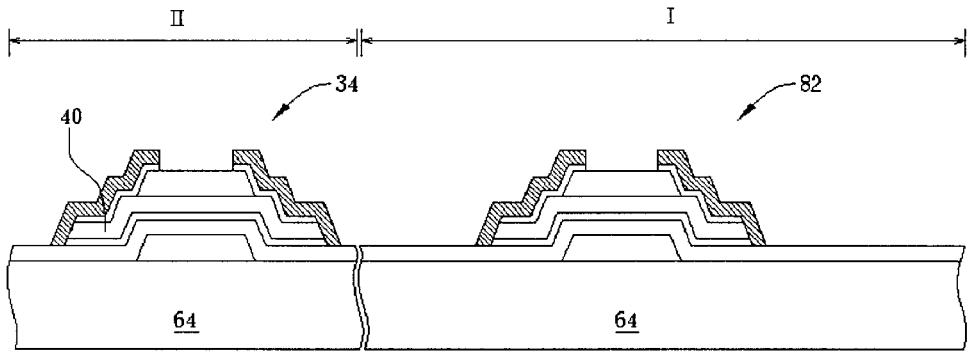
FIG. 6 is a cross-sectional view of the second substrate of the TFT-LCD.

FIG. 2 is a block diagram of a light source adjusting circuit 30 according to the present invention. FIG. 3 is a circuit diagram of the light source adjusting circuit 30 according to the present invention. FIG. 4 is a schematic diagram of a thin film transistor liquid crystal display (TFT-LCD) 60 capable of adjusting its light source according to the present invention. FIG. 5 is a top view illustrating a second substrate 64 of the TFT-LCD 60 according to the present invention. FIG. 6 is a cross-sectional view of the second substrate 64 of the TFT-LCD 60 along a line AA shown in FIG. 4. In a preferred embodiment of the present invention, the light source adjusting circuit 30 and the TFT-LCD 60 utilize a back light source 38 as an example. However, the present invention is not limited in the back light source 38, but also applies to a TFT-LCD having a front light source.

Please refer to FIG. 2 and FIG. 3. The light source adjusting circuit 30 includes a light source module 32, a photo sensor 34, and a feedback circuit 36. The light source module 32 includes the back light source 38 and a light source modulator 42. The feedback circuit 36 includes an amplified circuit 44 and a decisive circuit 46. The decisive circuit 46 comprises a processor, such as a photo diode D2 and a memory (not shown), and the memory includes a database (not shown). The photo sensor 34 is a thin film transistor (TFT) having an amorphous silicon layer 40 as shown in FIG. 6.

When an ambient light source 48 generates ambient light 50 passing through the amorphous silicon layer 40 of the TFT 34, the TFT 34 generates a photocurrent 52 that depends on the illumination of the ambient light 50. Since the photocurrent 52 is very weak, the amplified circuit 44 is used to amplify the photocurrent 52 to perform the subsequent signal processes conveniently. When a base of a transistor Q3 of the amplified circuit 44 receives a voltage signal converted from the photocurrent 52 by a resistance R3, an amplified signal 54 is sent from a collector of the transistor Q3 to the processor D2 of the decisive circuit 46 to calculate the illumination of the ambient light 50. After comparing the ambient illumination with the database of the memory, a feedback signal 56 is produced and transferred to the light source modulator 42, i.e. an inverter. Then, a pulse width modulation (PWM) controller 58 generates a PWM signal 59 corresponding to a pulse width to modulate a voltage pulse value, i.e. a voltage pulse frequency. After that, the voltage pulse value is transferred to a base of a transistor Q4, and a voltage source $V_M$ is indirectly connected to a transformer T2 by turning on and off the transistor Q4. Thereafter, a corresponding driving current, i.e. a lamp current is produced so that the back light source 38 generates a corresponding back light that depends on the lamp current. The light source modulator 42 can also utilize a voltage input device (not shown) to modulate the voltage pulse value to generate the corresponding driving current in order to adjust the back light source 38 of the TFT-LCD 60.

Please refer to FIG. 4 and FIG. 5. The light source adjusting circuit 30 is applied to the TFT-LCD 60 that is capable of adjusting its light source. The TFT-LCD 60 includes a first substrate 62, a second substrate 64 parallel to the first substrate 62, a color filter layer 66 and a transparent electrode 68 disposed on an underside of the first substrate 62 respectively, a polarizer 72 disposed on an above of the first substrate 62, a polarizer 74 disposed on an underside of the second substrate 64, and a liquid crystal 76 sealed between the first substrate 62 and the second substrate 64. The second substrate 64 includes an active region I and a peripheral region II, and a pixel matrix array 78 is disposed in the active region I of the second substrate 64. The pixel matrix array 78 includes a plurality of adjacent pixels 80, and each of the pixels 80 includes a thin film transistor 82. The first substrate 62 and the second substrate 64 are transparent glass substrates. The color filter layer 66 includes a R/G/B color filter array (CFA)(not shown) and a black filter array (not shown). The black filter array is used to prevent the TFT 82 from generating the photocurrent and cover light oblique leaks of the TFT-LCD 60.

The back light source 32 of the light source adjusting circuit 30 is disposed under the second substrate 64 of the TFT-LCD 60. The TFT 34 of the light source adjusting circuit 30 is disposed in the peripheral region 11 of the second substrate 64. Since the TFT 34 is utilized as the photo sensor, an upper side of the TFT 34 cannothold the black filter array. Instead, the TFT 34 must be exposed to the ambient light. The feedback circuit 36 of the light source adjusting circuit 30 is disposed outside the second substrate 64. The TFT 82 disposed in the active region I of the second substrate 64 and the TFT 34 disposed in the peripheral region II are formed simultaneously and have the same structure, as shown in FIG. 6.

When ambient light (not shown) enters the first substrate 62 of the TFT-LCD 60 and passes through the amorphous silicon layer 60 of the TFT 34, the TFT 34 generates and transfers a photocurrent to the feedback circuit 36. And a feedback signal is sent from the feedback circuit 36 to the light source modulator 42 of the light source module 32 to adjust the back light source 38 of the TFT-LCD 60 to an optimal brightness level that depends on ambient illumination. Similarly, a front light source (not shown) can be applied to the TFT-LCD of the present invention. Since the upper side of the TFT 34 does not hold the black filter array, the front light irradiates the amorphous silicon layer 40 of the TFT 34 directly to generate a photocurrent.

Please refer to FIG. 2 again, a signal trigger circuit (not shown) can be located between the photo sensor 34 and the decisive circuit 46. When the ambient illumination reaches an advanced set brightness level, which is a dark enough level to turn on the back light source 38, the signal trigger circuit outputs a signal to turn on the back light source 38 spontaneously. While the back light source 38 turned on, the feedback signal 56 sent from the decisive circuit 46 varies a lamp current output of the inverter according to variations of the ambient illumination to adjust the back light source 38 to an optimal brightness level.

In a word, the TFT-LCD capable of adjusting its light source of the present invention utilizes the TFT disposed in the peripheral region of the second substrate as the photo sensor. Therefore the back light source or the front light source of the TFT-LCD can be adjusted to an optimal brightness level that depends on ambient illumination spontaneously without causing eyestrain. When the ambient illumination is too bright or dark, the back light source or the front light source can be turned off or turned on spontaneously to save power.

In contrast to the prior art technology, the present invention utilizes the TFT disposed in the peripheral region of the second substrate as the photo sensor. Since the photo sensor and the TFT disposed inside the active region I are formed simultaneously, no additional photo sensor is required, simplifying manufacturing processes and reducing costs.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A thin film transistor liquid crystal display (TFT-LCD) capable of adjusting its light source;

the TFT-LCD comprising:

a liquid crystal sealed between a first substrate and a second substrate, the second substrate comprising an active region and a peripheral region;

a pixel matrix array disposed in the active region of the second substrate;

at least one thin film transistor (TFT) functioning as a photo sensor disposed in the peripheral region of the second substrate, the TFT comprising an amorphous silicon layer;

a feedback circuit; and a light source module comprising the light source and a light source modulator;

wherein when ambient light enters the first substrate and passes through the amorphous silicon layer of the TFT, the TFT generates and transfers a current to the feedback circuit, and then a feedback signal is sent from the feedback circuit to the light source modulator to adjust the light source of the TFT-LCD to an optimal brightness level that depends on ambient illumination.

2. The TFT-LCD of claim 1 wherein the first substrate and the second substrate are transparent glass substrates.

3. The TFT-LCD of claim 1 wherein the light source is a back light source.

4. The TFT-LCD of claim 1 wherein the light source is a front light source.

5. The TFT-LCD of claim 1 wherein the light source modulator modulates a voltage pulse value of the light source to vary a lamp current output of the light source.

6. The TFT-LCD of claim 1 wherein the light source modulator modulates a voltage pulse frequency of the light source to vary a lamp current output of the light source.

7. The TFT-LCD of claim 1 wherein the TFT is exposed to the ambient light.

8. The TFT-LCD of claim 1 wherein the feedback circuit comprises a memory and a processor electrically connected to the TFT.

9. The TFT-LCD of claim 8 wherein the processor receives and processes the current generated by the TFT to calculate the ambient illumination, and the feedback signal is generated after comparing the ambient illumination with data stored in the memory.

10. A thin film transistor liquid crystal display (TFT-LCD) for detecting an ambient illumination and adjusting a light source of the TFT-LCD to an optimal brightness level that depends on the ambient illumination;

the TFT-LCD comprising:

a liquid crystal sealed between a first substrate and a second substrate, the second substrate comprising an active region and a peripheral region;

a pixel matrix array disposed in the active region of the second substrate;

at least one thin film transistor (TFT functioning as a photo sensor disposed in the peripheral region of the second substrate, wherein the TFT comprises an amorphous silicon layer, and when the amorphous silicon layer of the TFT senses an ambient light, the TFT generates a current;

a feedback circuit for receiving the current generated by the TFT and outputting a feedback signal; and a light source module comprising the light source and a light source modulator, wherein the light source modulator receives the feedback signal sent from the feedback circuit and then adjusts the light source to the optimal brightness level.

11. The TFT-LCD of claim 10 wherein the feedback circuit comprises a processor electrically connected to the TFT and a memory comprising a database, the processor receives and processes the current generated by the TFT to calculate the ambient illumination, and the feedback signal is generated after comparing the ambient illumination with data stored in the database.

* * * * *